United States Patent [19]

Dresner et al.

[11] 4,088,510

[45] May 9, 1978

[54] MAGNESIUM OXIDE DYNODE AND METHOD OF PREPARATION

[75] Inventors: Joseph Dresner; Bernard Goldstein, both of Princeton, N.J.

[73] Assignee: RCA Corporation, New York, N.Y.

[21] Appl. No.: 659,250

[22] Filed: Feb. 19, 1976

[51] Int. Cl.[2] ..... C23F 7/06; H01J 1/32

[52] U.S. Cl. ..... 148/6.3; 427/77; 427/78; 427/350; 427/295; 148/31.5; 428/469

[58] Field of Search ..... 427/78, 77, 294, 295, 427/350; 148/6.3; 313/103 R; 316/20, 21; 428/469

[56] References Cited

U.S. PATENT DOCUMENTS

| | | | |
|---|---|---|---|
| 2,548,514 | 4/1951 | Bramley | 427/77 |
| 2,708,726 | 5/1955 | Atherton | 427/77 X |
| 2,784,123 | 3/1957 | Rappaport | 148/6.3 |
| 2,878,093 | 3/1959 | Wargo | 427/77 |

*Primary Examiner*—Ralph S. Kendall
*Attorney, Agent, or Firm*—E. M. Whitacre

[57] ABSTRACT

A layer of near stoichiometric magnesium oxide on a conducting substrate forms a dynode. The dynode is formed by preparing a layer of oxidized magnesium on a conducting substrate, heating the oxidized magnesium layer in a vacuum between about 400° and about 500° C, and treating the layer to render it more nearly stoichiometric. One method of treating the layer is to expose it to oxygen at about room temperature for about ten to twenty minutes at a pressure between about $10^{-6}$ to $10^{-5}$ torr. Another method of treating the layer is to impinge a noble gas, such as argon, at a pressure suitable for sputter etching, such as between $10^{-6}$ and $10^{-3}$ torr, to remove between ten and twenty atomic layers from the surface of the layer. The layer is then exposed to oxygen at room temperature for about ten to twenty minutes at a pressure between about $10^{-6}$ and $10^{-5}$ torr.

19 Claims, 2 Drawing Figures

MAGNESIUM OXIDE DYNODE AND METHOD OF PREPARATION

BACKGROUND OF THE INVENTION

The present invention relates to near stoichiometric magnesium oxide dynodes and to a method for preparing the dynodes.

The use of magnesium oxide as a dynode in an electron multiplier is well known. Dynodes are characterized by their ability to emit a plurality of secondary electrons for every incident primary electron. The secondary electron emission coefficient, $\delta$, which is the ratio of the number of secondary electrons per primary electron, is a measure of the efficiency of the dynode. Obviously a large $\delta$ is desirable since this reduces the number of stages of dynodes required for a given total electron multiplication. Heretofore, magnesium oxide dynodes have been made by a number of methods. One such method is described in U.S. Pat. No. 2,784,123 issued to P. Rappaport. That patent teaches the making of an MgO film on a AgMg metal alloy base by exposing the AgMg metal alloy to an oxidizing gas, such as water vapor, alcohol, carbon dioxide or nitrogen pentoxide. The AgMg metal alloy with a surface layer of MgO is then heated and exposed to oxygen. Another method is the oxidation of a 1000A thick Mg film at about 400° C. All of the foregoing methods, however, suffer from the drawback that the secondary electron emission coefficient $\delta$ of an MgO dynode prepared by these methods decreases in value with increase usage (see, e.g. "Preparation and Properties of Thin Film MgO Secondary Emitters" by P. Wargo, V. V. Haxby and W. G. Sheperd, *J. Appl. Phys.*, Vol. 27, p. 1311 (1956)).

SUMMARY OF THE INVENTION

A dynode comprises a layer of near stoichiometric magnesium oxide on an electrically conducting substrate. The dynode is formed by preparing a layer of oxidized magnesium on a conducting substrate, heating the layer in a vacuum between about 400° C and about 500° C, and treating the layer to render it more nearly stoichiometric.

DETAILED DESCRIPTION OF THE DRAWING

Figure 1:
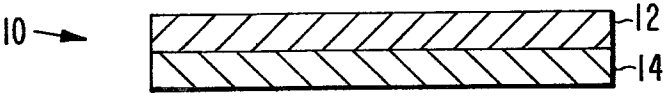
FIG. 1 is a cross-sectional view of the dynode of the present invention.

Referring to FIG. 1, there is shown a near stoichiometric magnesium oxide dynode of the present invention, generally designated as 10. The dynode 10 comprises a layer of near stoichiometric magnesium oxide 12 on a conducting substrate 14.

The dynode of the present invention is made by preparing a layer of oxidized magnesium on a conducting substrate. Preferably the layer of oxidized magnesium is less that about 1000A thick. The layer of oxidized magnesium can be formed by any one of the conventional methods, such as oxidizing a layer of magnesium at about 400° C. Thus far, the preparation of the layer of oxidized magnesium is well known in the art. The layer of oxidized magnesium is heated between about 400° and about 500° C for about one hour in a vacuum of less than about $10^{-7}$ torr. and then treated to render it more nearly stoichiometric.

One method of treating the layer of oxidized magnesium to render it more nearly stoichiometric is by exposing the layer to oxygen gas at about room temperature for about ten to twenty minutes at a pressure between about $10^{-6}$ and $10^{-5}$ torr. A higher pressure would require a shorter exposure time, and vice versa. In this method, it is believed that the heating step drives the impurities and unoxidized magnesium atoms from within the bulk onto the surface. The exposure to oxygen oxidizes the unoxidized magnesium atoms thereby rendering the layer more nearly stoichiometric.

Another method of treating the layer of oxidized magnesium to render it more nearly stoichiometric is by impinging a noble gas, such as argon, at a pressure suitable for sputter etching, such as between about 10−6 and $10^{-3}$ torr, on the layer to removed between about ten to twenty atomic layers from the surface of the layer of oxidized magnesium. The layer is then exposed to oxygen at about room temperature for about ten to twenty minutes at a pressure between about 10−6 and 10−5 torr. A higher pressure would require a shorter exposure time, and vice versa. In this method, it is believed that the heating step drives the impurities and unoxidized magnesium atoms from within the bulk onto the surface. The firing of the argon gas at the layer serves to remove the impurities and the unoxidized magnesium atoms from the surface. In addition to removing the impurities and the unoxidized magnesium atoms, however, this removal step may cause the removal of oxygen atoms bound in some of the magnesium oxide molecules—leaving some unoxidized magnesium atoms. Thus, the oxidation step after the bombardment of argon gas is necessary to oxidize these magnesium atoms that were inadvertently stripped of their oxygen atoms.

Figure 2:
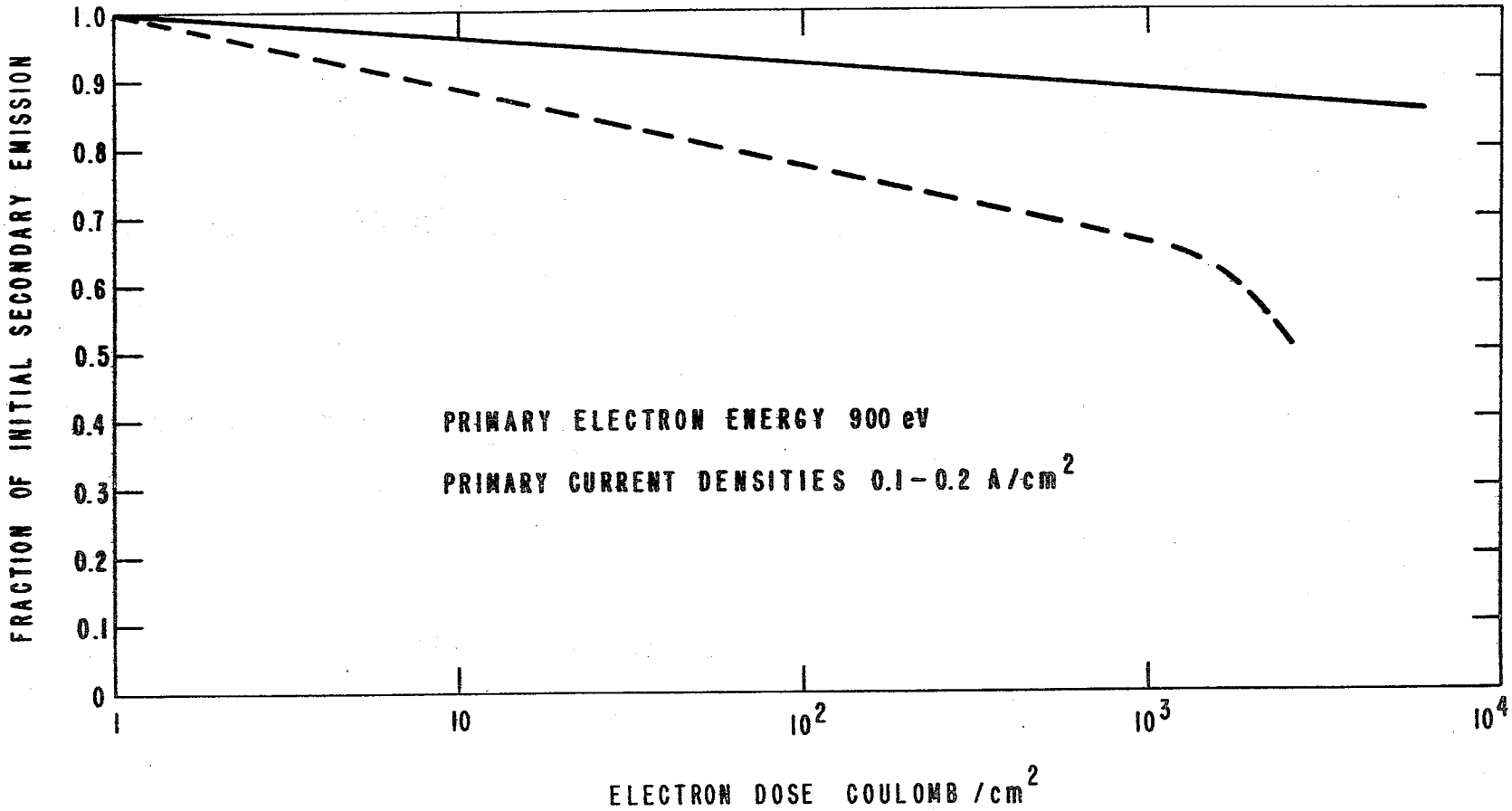
FIG. 2 is a graph of the comparison of the secondary electron emission coefficient of a prior art dynode and of a dynode of the present invention.

The advantage of a more nearly stoichiometric magnesium oxide dynode compared to a magnesium oxide dynode prepared by the prior art can be seen by referring to FIG. 2. FIG. 2 is a graph of normalized secondary electron emission coefficents of a magnesium oxide dynode prepared by oxidizing a layer of magnesium at about 400° C and of a magnesium oxide dynode of the present invention versus electron dose. The scale of electron dose or horizontal scale is logarithmic and it represents the amount of usage in time to which the dynodes have been subject. The scale of normalized secondary electron emission coefficient or vertical scale is the ratio of the secondary electron emission coefficient of the dynodes as it is being used, to the secondary electron emission coefficient of the dynodes initially tested. The initial values of the secondary electron emission coefficient $\delta$ of the dynode of the present invention and of the prior art magnesium oxide dynode are 6.5 and 9 respectively. From the graph it is seen that after the dynodes have been used for a time period equivalent to $10^2$ coulomb/cm$^2$, the prior art dynode will have a secondary electron emission coefficient about 0.78 of the initial value whereas the dynode of the present invention will have a secondary electron emission coefficient about 0.92 of the initial value. Compared to the prior art dynode, the dynode of the present invention exhibits a more stable secondary electron emission coefficient as a function of usage. We believe that this is caused by the near stoichiometry of the dynode of the present invention.

Dynodes are used in electron multiplication sections of photomultiplier tubes and other well known electron discharge tubes.

What is claimed is:

1. A dynode comprising an electrically conducting substrate; and a layer of magnesium oxide on said substrate, said layer formed by preparing a layer of oxidized magnesium on said substrate, treating the layer to render it more nearly stoichiometric wherein said treating includes heating said oxidized magnesium layer in a vacuum of less than about $10^{-7}$ torr at a temperature between about 400° and 500° C and exposing said dynode to oxygen at about room temperature.

2. The dynode of claim 1 wherein said exposing is carried out between about ten to twenty minutes.

3. The dynode of claim 2 wherein said exposing is carried out at a pressure between about $10^{-6}$ and $10^{-5}$ torr.

4. The dynode of claim 1 wherein said treating includes removing between about 10 to 20 atomic layers from the surface of said dynode.

5. The dynode of claim 4 wherein said removing is impinging noble gas molecules of said layer.

6. The dynode of claim 5 wherein said noble gas is argon.

7. The dynode of claim 6 wherein said argon gas is at a pressure of between about $10^{-5}$ and $10^{-3}$ torr.

8. The dynode of claim 2 wherein said exposing is carried out for about ten to twenty minutes.

9. The dynode of claim 8 wherein said exposing is carried out at a pressure between about $10^{-6}$ and $10^{-5}$ torr.

10. A method for making a magnesium oxide dynode comprising preparing a layer of oxidized magnesium on a conducting substrate; and treating said layer to render it more nearly stoichiometric wherein said treating includes heating said layer in a vacuum between about 400° and about 500° C at a pressure less than about $10^{-7}$ torr and exposing said dynode to oxygen at about room temperature.

11. The method in accordance with claim 10 wherein said heating is carried out for about one hour.

12. The method in accordance with claim 11 wherein said exposing is carried out between about 10 to 20 minutes.

13. The method in accordance with claim 12 wherein said exposing is carried out at a pressure between about $10^{-6}$ and $10^{-5}$ torr.

14. The method in accordance with claim 11 wherein said treating includes removing between about 10 to 20 atomic layers from the surface of said layer.

15. The method in accordance with claim 14 wherein said removing is impinging noble gas molecules on said layer.

16. The method in accordance with claim 15 wherein said noble gas is argon.

17. The method in accordance with claim 16 wherein said argon gas is at a pressure of between about $10^{-5}$ and $10^{-3}$ torr.

18. The method in accordance with claim 17 wherein said exposing is carried out for about ten to twenty minutes.

19. The method in accordance with claim 18 wherein said exposing is carried out at a pressure between about $10^{-6}$ and $10^{-5}$ torr.

* * * * *

UNITED STATES PATENT OFFICE
CERTIFICATE OF CORRECTION

PATENT NO. : 4,088,510

DATED : May 9, 1978

INVENTOR(S) : Joseph Dresner et al

It is certified that error appears in the above-identified patent and that said Letters Patent are hereby corrected as shown below:

| | |
|---|---|
| Column 2, line 17 | "10-6" should be --$10^{-6}$--; |
| lines 22-23 | "10-6 and 10-5" should be --$10^{-6}$ and $10^{-5}$--; |
| Claim 8, line 1 | "2" should be --7--. |

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*